US009200229B2

(12) United States Patent
Chahine et al.

(10) Patent No.: US 9,200,229 B2
(45) **Date of Patent: *Dec. 1, 2015**

(54) FRICTION MODIFIER AND THEIR USE IN LUBRICANTS AND FUELS

(71) Applicant: CASTROL LIMITED, Wiltshire (GB)

(72) Inventors: Samir Chahine, Berkshire (GB); James Edward Moss, Berkshire (GB)

(73) Assignee: CASTROL LIMITED, Reading (GB)

( * ) Notice: Subject to any disclaimer, the term of this patent is extended or adjusted under 35 U.S.C. 154(b) by 0 days.

This patent is subject to a terminal disclaimer.

(21) Appl. No.: 14/409,596

(22) PCT Filed: May 17, 2013

(86) PCT No.: PCT/EP2013/060257

§ 371 (c)(1),
(2) Date: Dec. 19, 2014

(87) PCT Pub. No.: WO2013/189674

PCT Pub. Date: Dec. 27, 2013

(65) Prior Publication Data

US 2015/0197703 A1 Jul. 16, 2015

(30) Foreign Application Priority Data

Jun. 20, 2012 (EP) ..... 12004645

(51) Int. Cl.

| | |
|---|---|
| ***C10L 1/22*** | (2006.01) |
| ***C10L 1/14*** | (2006.01) |
| ***C10M 105/36*** | (2006.01) |
| ***C10M 173/02*** | (2006.01) |
| ***C10M 133/06*** | (2006.01) |
| ***C10L 1/222*** | (2006.01) |
| ***C10L 10/08*** | (2006.01) |

(52) U.S. Cl.

CPC ..... *C10M 133/06* (2013.01); *C10L 1/2222* (2013.01); *C10L 10/08* (2013.01); *C10L 2200/0259* (2013.01); *C10L 2270/026* (2013.01); *C10M 2203/1025* (2013.01); *C10M 2207/026* (2013.01); *C10M 2207/028* (2013.01); *C10M 2215/04* (2013.01); *C10M 2219/046* (2013.01); *C10M 2223/045* (2013.01); *C10N 2230/02* (2013.01); *C10N 2230/06* (2013.01); *C10N 2230/42* (2013.01)

(58) Field of Classification Search

CPC ..... C10M 2207/125; C10M 2207/282; C10M 2215/042; C10M 2215/04

USPC ..... 508/459, 496, 500, 513; 44/391

See application file for complete search history.

(56) References Cited

U.S. PATENT DOCUMENTS

| | | | | |
|---|---|---|---|---|
| 2,790,778 | A | 4/1957 | Spivack et al. | |
| 3,418,092 | A | 12/1968 | Andress, Jr. et al. | |
| 3,926,581 | A * | 12/1975 | Plonsker | 44/360 |
| 2005/0198894 | A1 * | 9/2005 | Migdal et al. | 44/388 |
| 2010/0093573 | A1 | 4/2010 | Kocsis et al. | |

FOREIGN PATENT DOCUMENTS

IL 86 732 A 12/1992

OTHER PUBLICATIONS

PubChem Open Chemistry Database, Substance Record for SID 24868097, Sigma-Aldrich, Jul. 12, 2007.*

PubChem Open Chemistry Database, Substance Record for SID 24873439, Sigma-Aldrich, Jul. 12, 2007.*

PCT International Preliminary Report on Patentability, International Application No. PCT/EP2013/060257, International Filing Date May 17, 2013, mailed Dec. 31, 2014 (6 pages).

* cited by examiner

*Primary Examiner* — Vishal Vasisth

(74) *Attorney, Agent, or Firm* — Nixon & Vanderhye P.C.

(57) ABSTRACT

A non-aqueous lubricating composition containing a major amount of an oil of lubricating viscosity and a minor amount in the range of 0.02% to 5% by weight, of at least one compound having the structural formula (I):

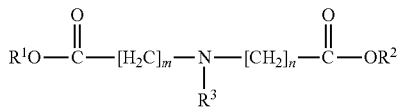

(I)

wherein m and n are each independently an integer in the range 1 to 6, $R^1$ and $R^2$ each independently represent a $C_1$ to $C_{10}$ hydrocarbyl or substituted hydrocarbyl group, and $R^3$ represents a $C_{10}$ to $C_{26}$ hydrocarbyl group.

18 Claims, No Drawings

FRICTION MODIFIER AND THEIR USE IN LUBRICANTS AND FUELS

This application is the U.S. national phase of International Application No. PCT/EP2013/060257 filed May 17, 2013 which designated the U.S. and claims priority to European Patent Application No. 12004645.3 filed Jun. 20, 2012, the entire contents of each of which are hereby incorporated by reference.

This invention relates to friction modifiers and their use in non-aqueous lubricating compositions and/or in fuel compositions.

It is known to use friction modifiers in lubricant compositions. It is also known to use friction modifiers in liquid fuel compositions for internal combustion engines.

US patent application publication US 2010/0093573 relates to a lubricating composition containing an oil of lubricating viscosity, an amine-containing friction modifier, and an ashless antiwear agent. It is stated in paragraph [0001] that the lubricating composition is suitable for lubricating and internal combustion engine. It is stated in paragraphs [016] to [0025] that the ashless anti-wear agent is represented by the Formula (I):

Formula (1)

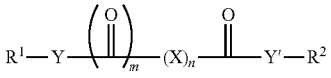

wherein:

Y and Y' are independently —O—, >NH, >$NR^3$, or an imide group formed by taking together both Y and Y' and forming a $R^1$—N< group between two >C═O groups;

X is independently —Z—O—Z'—, >$CH_2$, >CH $R^4$, >$CR^4R^5$, >C(OH)($CO_2R^2$), >C($CO_2$ $R^2$)$_2$, >$CH_2CO_2R^2$ or >$CHOR^6$;

Z and Z' are independently >$CH_2$, >$CHR^4$ or >$CR^4$ $R^5$, >C(OH)($CO_2R^2$), or >$CHOR^6$;

n is 0 to 10, or 1 to 8, or 1 to 6, or 2 to 6, or 2 to 4, with the proviso that when n=1, X is not >$CH_2$, and when n=2, both X's are not simultaneously >$CH_2$;

m is 0 or 1;

$R^1$ is independently hydrogen or a hydrocarbyl group, typically containing 1 to 150, 4 to 30, or 6 to 20, or 10 to 20, or 11 to 18 carbon atoms, with the proviso that when $R^1$ is hydrogen, m is 0, and n is more than or equal to 1;

$R^2$ is a hydrocarbyl group, typically containing 1 to 150, 4 to 30, or 6 to 20, or 10 to 20, or 11 to 18 carbon atoms;

$R^3$, $R^4$ and $R^5$ are independently hydrocarbyl groups or hydroxy-containing hydrocarbyl groups or carboxyl-containing hydrocarbyl groups; and $R^6$ is hydrogen or a hydrocarbyl group, typically containing 1 to 150, or 4 to 30 carbon atoms.

In paragraph [0057] thereof it is stated "The ashless antiwear agent of the invention, typically a tartrate, may also function as rust and corrosion inhibitors, friction modifiers, antiwear agents and demulsifiers". In paragraph [0100] thereof it is stated that: "In one embodiment the composition further comprises a friction modifier other than the amine-containing friction modifier of the invention". In paragraph [0102] thereof it is also stated: "In one embodiment the friction modifier is a long chain fatty acid ester (previously described above as an ashless antiwear agent)".

US patent application publication US 2010/0190669 relates to a method of lubricating an aluminium silicate composite surface with a lubricant comprising ashless, sulphur-free, phosphorous-free anti-wear agent. It is stated in paragraphs [0028] to [0036] that the ashless anti-wear agent is represented in one embodiment by the Formula (1a) and/or Formula (1 b):

Formula (1a)

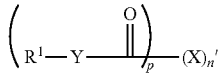

Formula (1b)

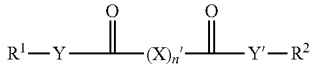

wherein:

n' is 0 to 10, 0 to 6, 0 to 4, 1 to 4, or 1 to 2 for Formula (1b), and 1 to 10, 1 to 4, or 1 to 2 for Formula (1a);

p is 1 to 5, or 1 to 2, or 1;

Y and Y' are independently —O—, >NH, >$NR^3$, or an imide group formed by taking together both Y and Y' groups in (1b) or two Y groups in (1a) and forming a $R^1$—N< group between two >C═O groups;

X is independently —$CH_2$—, >$CHR^4$ or >$CR^4$ $R^5$, >$CHOR^6$, or >C($CO_2R^6$)$_2$, >C($OR^6$)$CO_2$ $R^6$, >C($CH^2OR^6$)$CO_2R^6$, —$CH_3$, —$CH_2R^4$ or —$CHR^4R^5$, —$CH_2OR^6$, or —CH($CO_2R^6$)$_2$, ═C—$R^6$, or mixtures thereof to fulfill the valence of Formula (1a) and/or (1b), with the proviso that ═C—$R^6$ only applies to Formula (1a), the ═C referring to three single bonds to the carbon atom;

$R^1$ and $R^2$ are independently hydrocarbyl groups, typically containing 1 to 150, 4 to 30, or 6 to 20, or 10 to 20, or 11 to 18 carbon atoms;

$R^3$ is a hydrocarbyl group;

$R^4$ and $R^5$ are independently keto-containing groups (such as acyl groups), ester groups or hydrocarbyl groups; and $R^6$ is independently hydrogen or a hydrocarbyl group, typically containing 1 to 150 or 4 to 30 carbon atoms.

In paragraph [0027] thereof it is stated "The ashless antiwear agent of the invention, typically a tartrate, may also function as rust and corrosion inhibitors, friction modifiers, antiwear agents and demulsifiers". In paragraph [0087] thereof it is stated that: "In one embodiment the composition further comprises a friction modifier, or mixtures thereof.". In paragraph [0091] thereof it is also stated: "In one embodiment the friction modifier is a long chain fatty acid ester (previously described above as an ashless antiwear agent)".

US patent application publication US 2010/0197536 relates, in particular at paragraphs [0016] to [0025], to a lubricating composition comprising an oil of lubricating viscosity, an oil soluble molybdenum compound and an ashless antiwear agent represented by the Formula (1):

Formula (1)

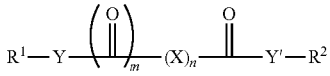

wherein:

Y and Y' are independently —O—, >NH, >$NR^3$, or an imide group formed by taking together both Y and Y' and forming a $R^1$—N< group between two >C═O groups;

X is independently —Z—O—Z'—, >$CH_2$, >$CHR^4$ or >$CR^4R^5$, >C(OH)($CO_2R^2$), >C($CO_2$ $R^2$)$_2$, >$CCH_2CO_3R^2$, or >$CHOR^6$;

Z and Z' are independently $>CH_2$, $>CHR^4$ or $>CR^4R^5$, $>C(OH)(CO_2R^2)$, or $>CHOR^6$;

n is 0 to 10, or 1 to 8, or 1 to 6, or 2 to 6, or 2 to 4, with the proviso that when n=1, X is not $>CH_2$, and when n=2, both X's are not simultaneously $>CH_2$;

m is 0 or 1;

$R^1$ is independently hydrogen or a hydrocarbyl group, typically containing 1 to 150, 4 to 30, or 6 to 20, or 10 to 20, or 11 to 18, or 8 to 10 carbon atoms, with the proviso that when $R^1$ is hydrogen, m is 0, and n is more than or equal to 1;

$R^2$ is a hydrocarbyl group, typically containing 1 to 150, 4 to 30, or 6 to 20, or 10 to 20, or 11 to 18, or 8 to 10 carbon atoms;

$R^3$, $R^4$ and $R^5$ are independently hydrocarbyl groups or hydroxy-containing hydrocarbyl groups or carboxyl-containing hydrocarbyl groups; and $R^6$ is hydrogen or a hydrocarbyl group, typically containing 1 to 150, or 4 to 30 carbon atoms.

In paragraph [0068] thereof it is stated "The ashless antiwear agent of the invention, typically a tartrate, may also function as rust and corrosion inhibitors, friction modifiers, antiwear agents and demulsifiers". In paragraph [0107] thereof it is stated that: "In one embodiment the composition further comprises a friction modifier, or mixtures thereof". In paragraph [0111] thereof it is also stated: "In one embodiment the friction modifier is a long chain fatty acid ester (previously described above as an ashless antiwear agent)".

There remains a need for friction modifier for use in a non-aqueous lubricating composition and/or in a fuel composition.

It has now been found that certain tertiary amine esters exhibit friction modifier benefits for example when used in non-aqueous lubricating compositions (for example, in non-aqueous lubricating compositions for lubricating internal combustion engines) and/or in fuel compositions (for example, in liquid fuel compositions for internal combustion engines).

Thus, according to an aspect of the present invention there is provided the use as a friction modifier in a non-aqueous lubricating composition, and/or in a fuel composition of at least one compound having the structural formula (I):

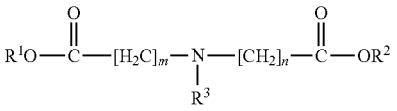

(I)

wherein:

m and n are each independently an integer in the range 1 to 6;

$R^1$ and $R^2$ each independently represent H or a $C_1$ to $C_{10}$ hydrocarbyl or substituted hydrocarbyl group; and $R^3$ represents a $C_{10}$ to $C_{26}$ hydrocarbyl group.

The compound represented by structural formula (I) is used as a friction modifier in a non-aqueous lubricating composition in an amount in the range of 0.02% to 5% by weight.

The compound represented by structural formula (I) is used a friction modifier in a fuel composition for an internal combustion engine at a concentration of up to 500 ppm by weight.

Thus, according to an aspect of the present invention there is provided a non-aqueous lubricating composition comprising a major amount of an oil of lubricating viscosity and a minor amount, in the range of 0.02% to 5% by weight, of at least one compound represented by the structural formula (I):

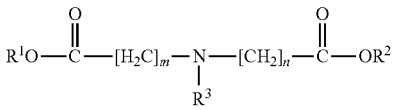

(I)

wherein:

m and n are each independently an integer in the range 1 to 6;

$R^1$ and $R^2$ each independently represent H or a $C_1$ to $C_{10}$ hydrocarbyl or substituted hydrocarbyl group; and $R^3$ represents a $C_{10}$ to $C_{26}$ hydrocarbyl group.

The lubricating composition may be used to lubricate an internal combustion engine. The lubricating composition may be used to lubricate the crankcase of an internal combustion engine. The internal combustion engine may be used in an automotive application. The internal combustion engine may be used in a marine application and/or in a land-based power generation plant.

Additionally or alternatively, the lubricating composition may be used to lubricate the cylinder (also called combustion chamber) of an internal combustion engine. Thus for example, the lubricating composition may be a cylinder lubricating composition (sometimes also called a cylinder oil). The lubricating composition may be a cylinder oil which may be used to lubricate the cylinder of a two-stroke diesel crosshead engine which may be used for example in a marine application and/or in a land-based power generation plant.

According to another aspect of the present invention, there is provided a method of lubricating an internal combustion engine which method comprises supplying to the engine an oil of lubricating viscosity and at least one compound represented by the structural formula (I):

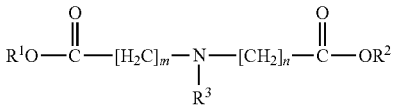

(I)

wherein:

m and n are each independently an integer in the range 1 to 6;

$R^1$ and $R^2$ each independently represent H or a $C_1$ to $C_{10}$ hydrocarbyl or substituted hydrocarbyl group; and $R^3$ represents a $C_{10}$ to $C_{26}$ hydrocarbyl group.

Suitably, the internal engine is lubricated with a lubricating composition according to the present invention.

The oil of lubricating viscosity and at the least one compound represented by the structural formula (I) may be supplied to the crankcase of the internal combustion engine in which embodiment, the internal combustion engine may be used for example, in an automotive application and/or the internal combustion engine may be used in a marine application and/or in a land-based power generation plant.

Additionally or alternatively, the oil of lubricating viscosity and at the least one compound represented by the structural formula (I) may be supplied to the combustion chamber or cylinder of the internal combustion engine in which embodiment the internal combustion engine may be for example, a two-stroke diesel crosshead engine which may be used for example in a marine application and/or in a land-based power generation plant. In a two-stroke engine which has a split lubrication system the compound represented by the structural formula (I) may thus be supplied to the crankcase lubricant (sometimes called system oil) and/or supplied to the cylinder oil.

Additionally or alternatively, the compound represented by the structural formula (I) may be provided in a liquid fuel composition used to operate the internal combustion engine and during operation of the engine at least a portion of the compound ingresses into a lubricating composition comprising an oil of lubricating viscosity, while the lubricating composition is used to lubricate the engine, for example as a crankcase lubricating composition.

According to another aspect of the present invention, there is provided a method of improving the friction properties of an oil of lubricating viscosity which method comprises admixing said oil with an effective amount in the range of 0.02% to 5% by weight of at least one compound represented by the structural formula (I):

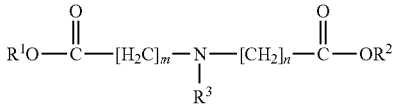

(I)

wherein:

m and n are each independently an integer in the range 1 to 6;

$R^1$ and $R^2$ each independently represent H or a $C_1$ to $C_{10}$ hydrocarbyl or substituted hydrocarbyl group; and $R^3$ represents a $C_{10}$ to $C_{26}$ hydrocarbyl group.

According to another aspect of the present invention, there is provided a method of preparing a non-aqueous lubricating composition which method comprises admixing an oil of lubricating viscosity with an effective amount in the range of 0.02% to 5% by weight of at least one compound represented by the structural formula (I):

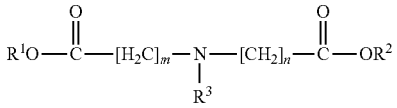

(I)

wherein:

m and n are each independently an integer in the range 1 to 6;

$R^1$ and $R^2$ each independently represent H or a $C_1$ to $C_{10}$ hydrocarbyl or substituted hydrocarbyl group; and $R^3$ represents a $C_{10}$ to $C_{26}$ hydrocarbyl group.

According to another aspect of the present invention, there is provided an additive concentrate for a non-aqueous lubricating composition comprising:

(i) at least one compound represented by the structural formula (I):

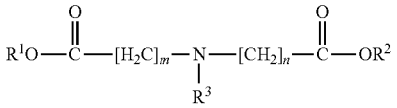

(I)

wherein:

m and n are each independently an integer in the range 1 to 6;

$R^1$ and $R^2$ each independently represent H or a $C_1$ to $C_{10}$ hydrocarbyl or substituted hydrocarbyl group; and $R^3$ represents a $C_{10}$ to $C_{26}$ hydrocarbyl group and (ii) at least one other lubricant additive.

The additive concentrate may be used in the method according to the present invention of improving the friction properties of an oil of lubricating viscosity. The additive concentrate may be used in the method of preparing a lubricating composition according to the present invention.

According to another aspect of the present invention, there is provided a fuel composition for an internal combustion engine which composition comprises a major amount of a liquid fuel and a minor amount at a concentration of up to 500 ppm by weight of at least one compound represented by the structural formula (I):

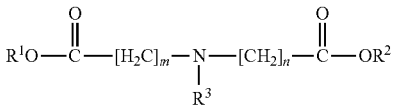

(I)

wherein:

m and n are each independently an integer in the range 1 to 6;

$R^1$ and $R^2$ each independently represent a $C_1$ to $C_{10}$ hydrocarbyl or substituted hydrocarbyl group; and $R^3$ represents a $C_{10}$ to $C_{26}$ hydrocarbyl group.

According to another aspect of the present invention, there is provided a method of improving the friction properties of a liquid fuel, which method comprises admixing said liquid fuel with an effective amount at a concentration of up to 500 ppm by weight of at least one compound represented by the structural formula (I):

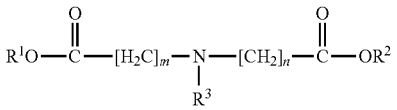

(I)

wherein:

m and n are each independently an integer in the range 1 to 6;

$R^1$ and $R^2$ each independently represent a $C_1$ to $C_{10}$ hydrocarbyl or substituted hydrocarbyl group; and $R^3$ represents a $C_{10}$ to $C_{26}$ hydrocarbyl group.

According to another aspect of the present invention, there is provided a method of preparing a fuel composition for an internal combustion engine, which method comprises admixing a liquid fuel with an effective amount at a concentration of up to 500 ppm by weight of at least one compound represented by the structural formula (I):

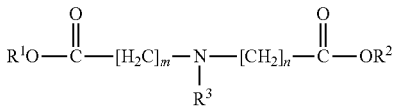

(I)

wherein:

m and n are each independently an integer in the range 1 to 6;

$R^1$ and $R^2$ each independently represent a $C_1$ to $C_{10}$ hydrocarbyl or substituted hydrocarbyl group; and $R^3$ represents a $C_{10}$ to $C_{26}$ hydrocarbyl group.

According to another aspect of the present invention, there is provided an additive concentrate for a fuel composition for an internal combustion engine, which composition comprises (i) at least one compound represented by the structural formula (I):

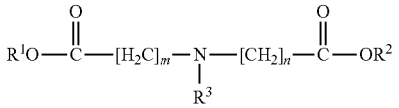

(I)

wherein:

m and n are each independently an integer in the range 1 to 6;

$R^1$ and $R^2$ each independently represent a $C_1$ to $C_{10}$ hydrocarbyl or substituted hydrocarbyl group; and $R^3$ represents a $C_{10}$ to $C_{26}$ hydrocarbyl group and (ii) at least one other fuel additive.

The additive concentrate may be used in the method according to the present invention of improving the friction properties of a liquid fuel. The additive concentrate may be used in the method of preparing a fuel composition according to the present invention.

According to another aspect of the present invention, there is provide a method of operating an internal combustion engine which method comprises supplying to the engine a liquid fuel, an oil of lubricating viscosity and at least one compound represented by the structural formula (I):

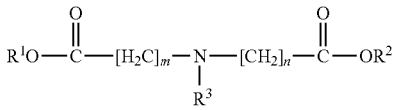

(I)

wherein:

m and n are each independently an integer in the range 1 to 6;

$R^1$ and $R^2$ each independently represent H or a $C_1$ to $C_{10}$ hydrocarbyl or substituted hydrocarbyl group; and $R^3$ represents a $C_{10}$ to $C_{26}$ hydrocarbyl group.

The compound of formula (I) may be supplied to the engine in admixture with the liquid fuel and/or with the oil of lubricating viscosity.

The compound represented by the structural formula (I) as herein defined has been found to exhibit friction modifier performance. Therefore, according to at least one embodiment the present invention provides, the use as a friction modifier in a non-aqueous lubricating composition, in an amount in the range of 0.02% to 5% by weight, and/or in a fuel composition for an internal combustion engine at a concentration of up to 500 ppm by weight, of at least one compound represented by the structural formula (I):

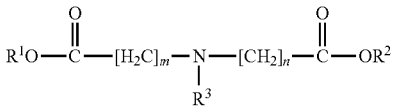

(I)

wherein:

m and n are each independently an integer in the range 1 to 6;

$R^1$ and $R^2$ each independently represent H or a $C_1$ to $C_{10}$ hydrocarbyl or substituted hydrocarbyl group; and $R^3$ represents a $C_{10}$ to $C_{26}$ hydrocarbyl group.

The present invention solves the technical problem defined above by the use as a friction modifier in a non-aqueous lubricating composition, in an amount in the range of 0.02% to 5% by weight, and/or in a fuel composition for an internal combustion engine at a concentration of up to 500 ppm by weight, of at least one compound represented by the structural formula (I):

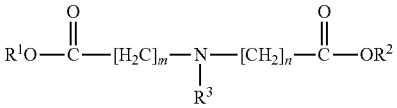

(I)

wherein:

m and n are each independently an integer in the range 1 to 6;

$R^1$ and $R^2$ each independently represent H or a $C_1$ to $C_{10}$ hydrocarbyl or substituted hydrocarbyl group; and $R^3$ represents a $C_{10}$ to $C_{26}$ hydrocarbyl group.

The use may be in any of the embodiments of the present invention including: the non-aqueous lubricating composition, the method of lubricating an internal combustion engine, the method of improving the friction properties of an oil of lubricating viscosity, the method of preparing a non-aqueous lubricating composition, the additive concentrate for a non-aqueous lubricating composition, the fuel composition (for example for an internal combustion engine), the method of improving the friction properties of a liquid fuel, the method of preparing a fuel composition for an internal combustion engine, the additive concentrate for a fuel composition for an internal combustion engine and the method of operating an internal combustion engine.

In at least one aspect, the present invention provides the use as a friction modifier in a non-aqueous lubricating composition, in an amount in the range of 0.02% to 5% by weight, and/or in a fuel composition for an internal combustion engine at a concentration of up to 500 ppm by weight, of at least one compound represented by the structural formula (I):

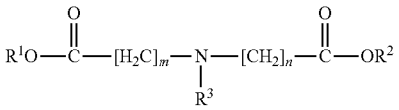

(I)

wherein:

m and n are each independently an integer in the range 1 to 6;

$R^1$ and $R^2$ each independently represent H or a $C_1$ to $C_{10}$ hydrocarbyl or substituted hydrocarbyl group; and $R^3$ represents a $C_{10}$ to $C_{26}$ hydrocarbyl group.

Suitably in structural formula (I), m and n may be independently integers in the range 1 to 3. In structural formula (I) m and n may be independently 1 or 2. In structural formula (I), m and n may each be 1. Suitably, in structural formula (I) m and n may be the same and are both 1.

In structural formula (I) 'hydrocarbyl group' means a group comprising carbon and hydrogen and which group is connected to the rest of the molecule through at least one carbon atom. A substituted hydrocarbyl group is a hydrocarbyl group which additionally comprises one or more heteroatoms, for example oxygen and/or nitrogen. The hydrocarbyl group or substituted hydrocarbyl group may be straight chain or branched chain. The hydrocarbyl or substituted hydrocarbyl group may be saturated or unsaturated. The hydrocarbyl or substituted hydrocarbyl group may be aliphatic, alicylic or aromatic. The hydrocarbyl or substituted hydrocarbyl group may be heterocyclic.

In structural formula (I), $R^3$ represents a $C_{10}$ to $C_{26}$ hydrocarbyl group, suitably $R^3$ may represent a $C_{10}$ to $C_{18}$ hydrocarbyl group, for example a $C_{12}$, $C_{14}$, $C_{16}$ or $C_{18}$ hydrocarbyl group. In some examples in structural formula (I) $R^3$ represents a saturated $C_{10}$ to $C_{26}$ hydrocarbyl group, for example a saturated $C_{10}$ to $C_{18}$ hydrocarbyl group. In some examples in structural formula (I) represents an unsaturated $C_{10}$ to $C_{26}$ hydrocarbyl group, for example an unsaturated $C_{10}$ to $C_{18}$ hydrocarbyl group. $R^3$ may represent a singly unsaturated hydrocarbyl group, for example an oleyl group.

In some examples in structural formula (I), $R^3$ represents an oleyl group.

In some examples in structural formula (I), $R^1$ and $R^2$ each independently represent H, that is a hydrogen moiety. In some examples in structural formula (I), $R^1$ and $R^2$ each independently represent a saturated hydrocarbyl group. In some examples in structural formula (I), $R^1$ and $R^2$ each independently represent a methyl, ethyl, n-propyl, iso-propyl, n-butyl, iso-butyl or tert-butyl group. In some examples in structural formula (I), $R^1$ and $R^2$ each independently represent an ethyl or tert-butyl group, for example in structural formula (I), $R^1$ and $R^2$ may be the same and both represent an ethyl or tert-butyl group.

In some examples in structural formula (I) $R^1$ and $R^2$ each independently represent a substituted hydrocarbyl group comprising at least one heteroatom which is selected from the group consisting of nitrogen, oxygen and combinations thereof.

A suitable compound represented by the structural formula (I) is diethyl-oleyl-iminodiacetate which is a compound represented by the structural formula (I) in which, $R^3$ represents oleyl; m=n=1; and $R^1$ and $R^2$ are the same and are ethyl groups.

A suitable compound represented by the structural formula (I) is di-t-butyl-oleyl-iminodiacetate which is a compound represented by the structural formula (I) in which, $R^3$ represents oleyl; m=n=1; and $R^1$ and $R^2$ are the same and are tert-butyl groups.

Lubricating Compositions and Additive Concentrates for Lubricating Compositions.

The amount of the compound represented by structural formula (I) in the lubricating composition according to at least one aspect of the present invention is in the range of 0.02% to 5% by weight, for example in the range of 0.1 to 2.5% by weight.

The concentration of the compound represented by structural formula (I) in the additive concentrate may be an amount suitable to provide the required concentration when used in the lubricating composition. The additive concentrate may be used in a lubricating composition in an amount of 0.5 to 30% by weight. Therefore, the amount of the compound represented by structural formula (I) and any other additives in the lubricant concentrate may be more concentrated than that in the lubricating composition, for example by a factor of from 1:0.005 to 1:0.30.

The lubricating composition comprises a major amount of oil of lubricating viscosity and a minor amount of the compound represented by structural formula (I). Major amount means greater than 50% and minor amount means less than 50% by weight.

The lubricating composition and the oil of lubricating viscosity may each comprise base oil. Base oil comprises at least one base stock. In at least some examples the oil of lubricating composition comprises one or more additives other than the compound represented by structural formula (I). Suitably, the lubricating composition and/or the oil of lubricating viscosity comprises base oil in an amount of from greater than 50% to about 99.5% by weight, for example from about 85% to about 95% by weight.

The base stocks may be defined as Group I, II, III, IV and V base stocks according to API standard 1509, "ENGINE OIL LICENSING AND CERTIFICATION SYSTEM", April 2007 version $16^{th}$ edition Appendix E, as set out in Table 1.

Group I, Group II and Group III base stocks may be derived from mineral oils Group I base stocks are typically manufactured by known processes comprising solvent extraction and solvent dewaxing, or solvent extraction and catalytic dewaxing. Group II and Group III base stocks are typically manufactured by known processes comprising catalytic hydrogenation and/or catalytic hydrocracking, and catalytic hydroisomerisation. A suitable Group I base stock is AP/E core 150, available from ExxonMobil. Suitable Group II basestocks are EHC 50 and EHC 110, available from ExxonMobil. Suitable group III base stocks include Yubase 4 and Yubase 6 available for example, from SK Lubricants. Suitable Group V base stocks are ester base stocks, for example Priolube 3970, available from Croda International plc. Suitable Group IV base stocks include hydrogenated oligomers of alpha olefins. Suitably, the oligomers may be made by free radical processes, Zeigler catalysis or by cationic Friedel-Crafts catalysis. Polyalpha olefin base stocks may be derived from C8, C10, C12, C14 olefins and mixtures of one or more thereof.

TABLE 1

| Group | Saturated hydrocarbon content (% by weight) ASTM D2007 | | Sulphur content (% by weight) ASTM D2622 or D4294 or D4927 or D3120 | | Viscosity Index ASTM D2270 |
|---|---|---|---|---|---|
| I | <90 | and/or | >0.03 | and | ≥80 and <120 |
| II | ≥90 | and | ≤0.03 | and | ≥80 and <120 |
| III | ≥90 | and | ≤0.03 | and | ≥120 |
| IV | polyalpha olefins | | | | |
| V | all base stocks not in Groups I, II, III or IV | | | | |

The lubricating composition and the oil of lubricating viscosity may each comprise one or more base oil and/or base stock which is/are natural oil, mineral oil (sometimes called petroleum-derived oil or petroleum-derived mineral oil), non-mineral oil and mixtures thereof. Natural oils include animal oils, fish oils, and vegetable oils. Mineral oils include paraffinic oils, naphthenic oils and paraffinic-naphthenic oils. Mineral oils may also include oils derived from coal or shale.

Suitable base oils and base stocks oils include those derived from processes such as chemical combination of simpler or smaller molecules into larger or more complex molecules (for example polymerisation, oligomerisation, condensation, alkylation, acylation).

Suitable base stocks and base oils include those derived from gas-to-liquids materials, coal-to-liquids materials, biomass-to-liquids materials and combinations thereof.

Gas-to-liquids materials (sometimes also referred to as GTL materials) may be obtained by one or more process steps of synthesis, combination, transformation, rearrangement, degradation and combinations of two or more thereof applied to gaseous carbon-containing compounds. GTL derived base stocks and base oils may be obtained from the Fischer-Tropsch synthesis process in which synthesis gas comprising a mixture of hydrogen and carbon monoxide is catalytically converted to hydrocarbons, usually waxy hydrocarbons that are generally converted to lower-boiling materials hydroisomerisation and/or dewaxing (see for example, WO 2008/124191).

Biomass-to-liquids materials (sometimes also referred to as BTL materials) may be manufactured from compounds of plant origin for example by hydrogenation of carboxylic acids or triglycerides to produce linear paraffins, followed by hydroisomerisation to produced branched paraffins (see for example, WO-2007-068799-A).

Coal-to-liquids materials may be made by gasifying coal to make synthesis gas which is then converted to hydrocarbons.

The base oil and/or oil of lubricating viscosity may each have a kinematic viscosity at 100° C. in the range of 2 to 100 cSt, suitably in the range of 3 to 50 cSt and more suitably in the range 3.5 to 25 cSt.

In at least some examples the lubricating composition of the present invention is a monograde lubricating oil composition according to API classification, for example SAE 20, 30, 40, 50 or 60 grade.

In at least some examples the lubricating composition of the present invention is a multi-grade lubricating composition according to the API classification xW-y where x is 0, 5, 10, 15 or 20 and y is 20, 30, 40, 50 or 60 as defined by SAE J300 2004, for example 5W-20, 5W-30, 0W-20. In at least some examples the lubricating composition has an HTHS viscosity at 150° C. of at least 2.6 cP, for example as measured according to ASTM D4683, CEC L-36-A-90 or ASTM D5481.

In at least some examples the lubricating composition has an HTHS viscosity at 150° C. according to ASTM D4683 of from 1 to <2.6 cP, for example 1.8 cP.

The lubricating composition may be prepared by admixing an oil of lubricating viscosity with an effective amount of the compound represented by structural formula (I) together with optionally at least one other lubricant additive.

The method of preparing a lubricating composition and the method of improving the friction properties of an oil of lubricating viscosity comprise admixing an oil of lubricating viscosity with an effective amount of the at least one compound represented by the structural formula (I).

In at least some examples the oil of lubricating viscosity is admixed with the compound represented by structural formula (I) in one or more steps by methods known in the art. In at least some examples the compound represented by structural formula (I) is admixed as one or more additive concentrates or part additive package concentrates, optionally comprising solvent or diluent. In at least some examples the oil of lubricating viscosity is prepared by admixing in one or more steps by methods known in the art, one or more base oils and/or base stocks optionally with one or more additives and/or part additive package concentrates. In at least some examples the compound represented by structural formula (I), additive concentrates and/or part additive package concentrates are admixed with oil of lubricating viscosity or components thereof in one or more steps by methods known in the art.

The lubricating composition and the additive concentrate for a lubricating composition may each further comprise at least one other lubricant additive. In at least some examples the at least one other lubricant additive is multi-functional i.e. it performs more than one function in the composition.

Other Friction Modifiers.

The lubricating composition and the additive concentrate for a lubricating composition may each further comprise at least one friction modifier other than the compound represented by structural formula (I). Such other friction modifiers include those that are ash-producing additives or ashless additives. Examples of such friction modifiers include fatty acid derivatives including for example, other fatty acid esters, amides, amines, and ethoxylated amines. Examples of suitable ester friction modifiers include esters of glycerol for example, mono-, di-, and tri-oleates, mono-palmitates and mono-myristates. A particularly suitable fatty acid ester friction modifier is glycerol monooleate. Examples of friction modifiers also include molybdenum compounds for example, organo molybdenum compounds, molybdenum dialkyldithiocarbamates, molybdenum dialkylthiophosphates, molybdenum disulphide, tri-molybdenum cluster dialkyldithiocarbamates, non-sulphur molybdenum compounds and the like. Suitable molybdenum-containing compounds are described for example, in EP-1533362-A1 for example in paragraphs [0101] to [0117].

Suitable friction modifiers also include a combination of an alkoxylated hydrocarbyl amine and a polyol partial ester of a saturated or unsaturated fatty acid or a mixture of such esters, for example as described in WO 93/21288.

In at least some examples friction modifiers that are fatty acid derivative friction modifiers are present in the lubricating composition at a concentration of 0.01 to 5% by weight actives, more suitably in the range of 0.01 to 1.5% by weight actives.

In at least some examples molybdenum containing friction modifiers are present in the lubricating composition at a concentration of 10 to 1000 ppm by weight molybdenum, more suitably in the range of 400 to 600 ppm by weight.

Anti-Wear Additives

The lubricating composition and the additive concentrate for a lubricating composition may each further comprise at least one anti-wear additive. Such anti-wear additives include those that are ash-producing additives or ashless additives. Examples of such anti-wear additives include non-phosphorus containing additives for example, sulphurised olefins. Examples of such anti-wear additives also include phosphorus-containing antiwear additives. Examples of suitable ashless phosphorus-containing anti-wear additives include trilauryl phosphite and triphenylphosphorothionate and those disclosed in paragraph [0036] of US2005/0198894. Examples of suitable ash-forming, phosphorus-containing anti-wear additives include dihydrocarbyl dithiophosphate metal salts. Examples of suitable metals of the dihydrocarbyl dithiophosphate metal salts include alkali and alkaline earth metals, aluminium, lead, tin, molybdenum, manganese, nickel, copper and zinc. Particularly suitable dihydrocarbyl dithiophosphate metal salts are zinc dihydrocarbyl dithiophosphates (ZDDP). The ZDDP's may have hydrocarbyl groups independently having 1 to 18 carbon atoms, suitably 2 to 13 carbon atoms or 3 to 18 carbon atoms, more suitably 2 to 12 carbon atoms or 3 to 13 carbon atoms, for example 3 to 8 carbon atoms. Examples of suitable hydrocarbyl groups include alkyl, cycloalkyl and alkaryl groups which may contain ether or ester linkages and also which may contain substituent groups for example, halogen or nitro groups. The hydrocarbyl groups may be alkyl groups which are linear and/or branched and suitably may have from 3 to 8 carbon atoms. Particularly suitable ZDDP's have hydrocarbyl groups which are a mixture of secondary alky groups and primary alkyl groups for example, 90 mol. % secondary alkyl groups and 10 mol. % primary alkyl groups.

In at least some examples phosphorus-containing anti-wear additives are present in the lubricating composition at a concentration of 10 to 6000 ppm by weight of phosphorus, suitably 10 to 1000 ppm by weight of phosphorus, for example 200 to 1400 ppm by weight of phosphorus, or 200 to 800 ppm by weight of phosphorus or 200 to 600 ppm by weight of phosphorus.

Other Additives.

The lubricating composition and the additive concentrate for a lubricating composition may each also comprise other lubricant additives. Examples of such other additives include dispersants (metallic and non-metallic), dispersant viscosity modifiers, detergents (metallic and non-metallic), viscosity index improvers, viscosity modifiers, pour point depressants, rust inhibitors, corrosion inhibitors, antioxidants (sometimes also called oxidation inhibitors), anti-foams (sometimes also called anti-foaming agents), seal swell agents (sometimes also called seal compatibility agents), extreme pressure additives (metallic, non-metallic, phosphorus containing, non-phosphorus containing, sulphur containing and non-sulphur containing), surfactants, demulsifiers, anti-seizure agents, wax modifiers, lubricity agents, anti-staining agents, chromophoric agents and metal deactivators.

Dispersants

Dispersants (also called dispersant additives) help hold solid and liquid contaminants for example resulting from oxidation of the lubricating composition during use, in suspension and thus reduce sludge flocculation, precipitation and/or deposition for example on lubricated surfaces. They generally comprise long-chain hydrocarbons, to promote oil-solubility, and a polar head capable of associating with material to be dispersed. Examples of suitable dispersants include oil soluble polymeric hydrocarbyl backbones each having one or more functional groups which are capable of associating with particles to be dispersed. The functional groups may be amine, alcohol, amine-alcohol, amide or ester groups. The functional groups may be attached to the hydrocarbyl backbone through bridging groups. More than one dispersant may be present in the additive concentrate and/or lubricating composition.

Examples of suitable ashless dispersants include oil soluble salts, esters, amino-esters, amides, imides and oxazolines of long chain hydrocarbon-substituted mono- and polycarboxylic acids or anhydrides thereof; thiocarboxylate derivatives of long chain hydrocarbons; long chain aliphatic hydrocarbons having polyamine moieties attached directly thereto; Mannich condensation products formed by condensing a long chain substituted phenol with formaldehyde and polyalkylene polyamine; Koch reaction products and the like. Examples of suitable dispersants include derivatives of long chain hydrocarbyl-substituted carboxylic acids, for example in which the hydrocarbyl group has a number average molecular weight of up to 20000, for example 300 to 20000, 500 to 10000, 700 to 5000 or less than 15000. Examples of suitable dispersants include hydrocarbyl-substituted succinic acid compounds, for example succinimide, succinate esters or succinate ester amides and in particular, polyisobutenyl succinimide dispersants. The dispersants may be borated or non-borated. A suitable dispersant is ADX 222.

Dispersant Viscosity Modifiers.

Additionally or alternatively, dispersancy may be provided by polymeric compounds capable of providing viscosity index improving properties and dispersancy. Such compounds are generally known as dispersant viscosity improver additives or multifunctional viscosity improvers. Examples of suitable dispersant viscosity modifiers may be prepared by chemically attaching functional moieties (for example amines, alcohols and amides) to polymers which tend to have number average molecular weights of at least 15000, for example in the range 20000 to 600000 (for example as determined by gel permeation chromatography or light scattering methods). Examples of suitable dispersant viscosity modifiers and methods of making them are described in WO 99/21902, WO2003/099890 and WO2006/099250. More than one dispersant viscosity modifier may be present in the additive concentrate and/or lubricating composition.

Detergents

Detergents (also called detergent additives) may help reduce high temperature deposit formation for example on pistons in internal combustion engines, including for example high-temperature varnish and lacquer deposits, by helping to keep finely divided solids in suspension in the lubricating composition. Detergents may also have acid-neutralising properties. Ashless (that is non-metal containing detergents) may be present. Metal-containing detergent comprises at least one metal salt of at least one organic acid, which is called soap or surfactant. Detergents may be overbased in which the detergent comprises an excess of metal in relation to the stoichiometric amount required to neutralise the organic acid. The excess metal is usually in the form of a colloidal dispersion of metal carbonate and/or hydroxide. Examples of suitable metals include Group I and Group 2 metals, more suitably calcium, magnesium and combinations thereof, especially calcium. More than one metal may be present.

Examples of suitable organic acids include sulphonic acids, phenols (sulphurised or preferably sulphurised and including for example, phenols with more than one hydroxyl group, phenols with fused aromatic rings, phenols which have been modified for example alkylene bridged phenols, and Mannich base-condensed phenols and saligenin-type phenols, produced for example by reaction of phenol and an aldehyde under basic conditions) and sulphurised derivatives thereof, and carboxylic acids including for example, aromatic carboxylic acids (for example hydrocarbyl-substituted salicylic acids and sulphurised derivatives thereof, for example hydrocarbyl substituted salicylic acid and derivatives thereof). More than one type of organic acid may be present.

Additionally or alternatively, non-metallic detergents may be present. Suitable non-metallic detergents are described for example in U.S. Pat. No. 7,622,431.

More than one detergent may be present in the lubricating composition and/or additive concentrate.

Viscosity Index Improvers/Viscosity Modifiers

Viscosity index improvers (also called viscosity modifiers, viscosity improvers or VI improvers) impart high and low temperature operability to a lubricating composition and facilitate it remaining shear stable at elevated temperatures whilst also exhibiting acceptable viscosity and fluidity at low temperatures.

Examples of suitable viscosity modifiers include high molecular weight hydrocarbon polymers (for example polyisobutylene, copolymers of ethylene and propylene and higher alpha-olefins); polyesters (for example polymethacrylates); hydrogenated poly(styrene-co-butadiene or isoprene) polymers and modifications (for example star polymers); and esterified poly(styrene-co-maleic anhydride) polymers. Oil-soluble viscosity modifying polymers generally have number average molecular weights of at least 15000 to 1000000, preferably 20000 to 600000 as determined by gel permeation chromatography or light scattering methods.

Viscosity modifiers may have additional functions as multifunction viscosity modifiers. More than one viscosity index improver may be present.

Pour Point Depressants

Pour point depressants (also called lube oil improvers or lube oil flow improvers), lower the minimum temperature at which the lubricating composition will flow and can be poured. Examples of suitable pour point depressants include $C_8$ to $C_{18}$ dialkyl fumarate/vinyl acetate copolymers, methacrylates, polyacrylates, polyarylamides, polymethacrylates, polyalkyl methacrylates, vinyl fumarates, styrene esters, condensation products of haloparaffin waxes and aromatic compounds, vinyl carboxylate polymers, terpolymers of dialkyfumarates, vinyl esters of fatty acids and allyl vinyl ethers, wax naphthalene and the like.

More than one pour point depressant may be present.

Rust Inhibitors

Rust inhibitors generally protect lubricated metal surfaces against chemical attack by water or other contaminants. Examples of suitable rust inhibitors include non-ionic polyoxyalkylene polyols and esters thereof, polyoxyalkylene phenols, polyoxyalkylene polyols, anionic alky sulphonic acids, zinc dithiophosphates, metal phenolates, basic metal sulphonates, fatty acids and amines.

More than one rust inhibitor may be present.

Corrosion Inhibitors

Corrosion inhibitors (also called anti-corrosive agents) reduce the degradation of metallic parts contacted with the lubricating composition. Examples of corrosion inhibitors include phosphosulphurised hydrocarbons and the products obtained by the reaction of phosphosulphurised hydrocarbon with an alkaline earth metal oxide or hydroxide, non-ionic polyoxyalkylene polyols and esters thereof, polyoxyalkylene phenols, thiadiazoles, triazoles and anionic alkyl sulphonic acids. Examples of suitable epoxidised ester corrosion inhibitors are described in US2006/0090393.

More than one corrosion inhibitor may be present.

Antioxidants

Antioxidants (sometimes also called oxidation inhibitors) reduce the tendency of oils to deteriorate in use. Evidence of such deterioration might include for example the production of varnish-like deposits on metal surfaces, the formation of sludge and viscosity increase. ZDDP's exhibit some antioxidant properties.

Examples of suitable antioxidants other than ZDDP's include alkylated diphenylamines, N-alkylated phenylenediamines, phenyl-α-naphthylamine, alkylated phenyl-α-naphthylamines, dimethylquinolines, trimethyldihydroquinolines and oligomeric compositions derived therefrom, hindered phenolics (including ashless (metal-free) phenolic compounds and neutral and basic metal salts of certain phenolic compounds), aromatic amines (including alkylated and non-alkylated aromatic amines), sulphurised alkyl phenols and alkali and alkaline earth metal salts thereof, alkylated hydroquinones, hydroxylated thiodiphenyl ethers, alkylidenebisphenols, thiopropionates, metallic dithiocarbamates, 1,3,4-dimercaptothiadiazole and derivatives, oil soluble copper compounds (for example, copper dihydrocarbyl thio- or thiophosphate, copper salts of a synthetic or natural carboxylic acids, for example a $C_8$ to $C_{18}$ fatty acid, an unsaturated acid or a branched carboxylic acid, for example basic, neutral or acidic $Cu^I$ and/or $Cu^{II}$ salts derived from alkenyl succinic acids or anhydrides), alkaline earth metal salts of alkylphenolthioesters, suitably having $C_5$ to $C_{12}$ alkyl side chains, calcium nonylphenol sulphide, barium t-octylphenyl sulphide, dioctylphenylamine, phosphosulphised or sulphurised hydrocarbons, oil soluble phenates, oil soluble sulphurised phenates, calcium dodecylphenol sulphide, phosphosulphurised hydrocarbons, sulphurised hydrocarbons, phosphorus esters, low sulphur peroxide decomposers and the like.

More than one antioxidant may be present. More than one type of antioxidant may be present.

Antifoams

Anti-foams (sometimes also called anti-foaming agents) retard the formation of stable foams. Examples of suitable anti-foam agents include silicones, organic polymers, siloxanes (including poly siloxanes and (poly)dimethyl siloxanes, phenyl methyl siloxanes), acrylates and the like.

More than one anti-foam may be present.

Seal Swell Agents

Seal swell agents (sometimes also called seal compatibility agents or elastomer compatibility aids) help to swell elastomeric seals for example by causing a reaction in the fluid or a physical change in the elastomer. Examples of suitable seal swell agents include long chain organic acids, organic phosphates, aromatic esters, aromatic hydrocarbons, esters (for example butylbenzyl phthalate) and polybutenyl succinic anhydride.

More than one seal swell agent may be present.

Other Additives

Examples of other additives that may be present in the lubricating composition and/or additive concentrate include extreme pressure additives (including metallic, non-metallic, phosphorus containing, non-phosphorus containing, sulphur containing and non-sulphur containing extreme pressure additives), surfactants, demulsifiers, anti-seizure agents, wax modifiers, lubricity agents, anti-staining agents, chromophoric agents and metal deactivators.

Some additives may exhibit more than one function.

The amount of demulsifier, if present, might be higher than in conventional lubricating compositions to off-set any emulsifying effect of the compound represented by structural formula (I).

Solvent

The additive concentrate for a lubricating composition may comprise solvent. Examples of suitable solvents include highly aromatic, low viscosity base stocks, for example 100N, 60 N and 100SP base stocks.

The representative suitable and more suitable independent amounts of additives (if present) in the lubricating composition are given in Table 2. The concentrations expressed in Table 2 are by weight of active additive compounds that is, independent of any solvent or diluent.

More than one of each type of additive may be present. Within each type of additive, more than one class of that type of additive may be present. More than one additive of each class of additive may be present. Additives may suitably be supplied by manufacturers and suppliers in solvent or diluents.

TABLE 2

| | Lubricating composition | |
|---|---|---|
| ADDITIVE TYPE | Suitable amount (actives), if present (by weight) | More suitable amount (actives), if present (by weight) |
| Friction modifier compound represented by structural formula (I) | 0.02 to 5% | 0.1 to 2.5% |
| Phosphorus-containing anti-wear additives | corresponding to 10 to 6000 ppm P | corresponding to 10 to 1000 ppm P |
| Molybdenum-containing anti-wear additives | corresponding to 10 to 1000 ppm Mo | corresponding to 40 to 600 ppm Mo |
| Boron-containing anti-wear additives | corresponding to 10 to 250 ppm B | corresponding to 50 to 100 ppm B |
| Friction modifiers other than compound represented by structural formula (I) | 0.01 to 5% | 0.01 to 1.5% |
| Molybdenum-containing friction modifiers | corresponding to 10 to 1000 ppm Mo | corresponding to 400 to 600 ppm Mo |
| Dispersants | 0.1 to 20% | 0.1 to 8% |
| Detergents | 0.01 to 20% | 0.01 to 4% |
| Viscosity index improvers | 0.01 to 20% | 0.01 to 15% |
| Pour point depressants | 0.01 to 5% | 0.01 to 1.5% |
| Corrosion and/or rust inhibitors | 0.01 to 5% | 0.01 to 1.5% |
| Anti-oxidants | 0.1 to 10% | 0.5 to 5% |
| Antifoams containing silicon | corresponding to 1 to 20 ppm Si | corresponding to 1 to 10 ppm Si |

Lubricating Composition Applications.

In at least some examples the compound represented by structural formula (I) is used as a friction modifier in a non-aqueous lubricating composition and/or in a fuel composition.

The compound represented by structural formula (I) may be used as a friction modifier in a lubricating composition that may be used, for example to lubricate the crankcase of an internal combustion engine which may be used for example in automotive applications, in marine applications and/or land-based power generation plants.

In at least some examples the compound represented by structural formula (I) is used as a friction modifier in a lubricating composition which is a functional fluid, for example a metalworking fluid which may be used to lubricate metals during machining, rolling and the like. Suitably, the lubricating composition is a lubricating composition according to the present invention.

In at least some examples the compound represented by structural formula (I) is used as a friction modifier in a lubricating composition which is a power transmission fluid for example useful as an automatic transmission fluid, a fluid in a clutch (for example a dual clutch), a gear lubricating composition, or in other automotive applications and the like. Suitably, the lubricating composition is a lubricating composition according to the present invention.

In at least some examples the compound represented by structural formula (I) is used as a friction modifier in a non-aqueous lubricating composition and/or in a fuel composition used to lubricate a solid surface, including for example metallic surfaces and non-metallic surfaces. Suitable metallic surfaces include surfaces of ferrous based materials, for example cast iron and steels; surfaces of aluminium-based solids, for example aluminium-silicon alloys; surfaces of metal matrix compositions; surfaces of copper and copper alloys; surfaces of lead and lead alloys; surfaces of zinc and zinc alloys; and surfaces of chromium-plated materials. Suitable non-metallic surfaces include surfaces of ceramic materials; surfaces of polymer materials; surfaces of carbon-based materials; and surfaces of glass. Other surfaces which may be lubricated include surfaces of coated materials for example surfaces of hybrid materials for example metallic materials coated with non-metallic materials and non-metallic materials coated with metallic materials; surfaces of diamond-like carbon coated materials and SUMEBore™ materials for example as described in Sultzer technical review 4/2009 pages 11-13.

In at least some examples the compound represented by structural formula (I) is used in a non-aqueous lubricating composition and/or in a fuel composition to lubricate a surface at any typical temperature which might be encountered in a lubricating environment, for example at a temperature such as may be encountered in an internal combustion engine, for example a temperature in the range of ambient to 250° C., e.g. 90 to 120° C. Typically ambient temperature may be 20° C., but may be less than 20° C., for example 0° C.

Internal Combustion Engine Lubrication.

In at least some examples the compound represented by structural formula (I) is used as a friction modifier in a lubricating composition which may be used to lubricate an internal combustion engine, for example as a crankcase lubricating composition. Suitable engines include a spark-ignition, internal combustion engines and compression-ignition, internal combustion engines. The internal combustion engine may be a spark-ignition internal combustion engine used in automotive or aviation applications. In at least some examples the internal combustion engine is a two-stroke compression-ignition engine and the compound represented by structural formula (I) is used as a friction modifier in a system oil lubricating composition and/or a cylinder oil lubricating composition used to lubricate the engine. The two-stroke compression-ignition engine may be used in marine applications.

In the method of lubricating an internal combustion engine, the compound represented by structural formula (I) may be present in a lubricating composition used to lubricate the engine, for example to lubricate the crankcase of the engine. Suitably, such a lubricating composition is a lubricating composition according to the present invention.

In at least some examples the compound represented by structural formula (I) is added to the lubricating composition used to the lubricate the engine by slow release of the additive into the lubricating composition—for example by contacting the lubricating composition with a gel comprising the additive, for example as described in U.S. Pat. No. 6,843,916 and international PCT patent application publication WO 2008/008864 and/or by controlled release of the additive, for example when the back pressure of lubricating composition passing through a filter exceeds a define back pressure, for example as described in international PCT patent application publication WO2007/148047.

Additionally, or alternatively the compound represented by structural formula (I) may be present in the fuel for an internal combustion engine. In use, the compound represented by structural formula (I) may pass with or without fuel into a lubricating composition used to lubricate the engine, for example as a crankcase lubricating composition and thereby provide friction modifier benefits to the lubricating composition and the engine.

Thus according to a further aspect of the present invention, there is provided a fuel composition for an internal combustion engine which composition comprises a major amount of a liquid fuel and a minor amount of at least one compound represented by the structural formula (I):

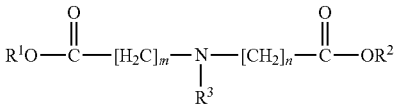

(I)

wherein m and n are each independently an integer in the range 1 to 6;

$R^1$ and $R^2$ each independently represent a $C_1$ to $C_{10}$ hydrocarbyl or substituted hydrocarbyl group; and $R^3$ represents a $C_{10}$ to $C_{26}$ hydrocarbyl group.

In at least some examples the engine is a spark-ignition, internal combustion engine, or a compression-ignition, internal combustion engine. In at least some examples the engine is a homogeneous charge compression ignition internal combustion engine. Suitable internal combustion engines include spark-ignition internal combustion engines that are used in automotive or aviation applications. In at least some examples the internal combustion engine is a two-stroke compression-ignition engine, for example as in marine applications.

The compound represented by structural formula (I) is present in the fuel according to at least another aspect of the present invention, at a concentration of up to 500 ppm by weight, for example 20 to 200 ppm by weight or 50 to 100 ppm by weight.

Typically, the rate of ingress of fuel into crankcase lubricating composition is higher for spark-ignition internal combustion engines than for compression-ignition engines. However, the rate at which fuel ingresses into the crankcase lubricating composition for compression-ignition engines may depend and may increase depending upon the use of post-injection strategies for operation of the engine.

The compound represented by structural formula (I) present in the fuel composition may provide a reduction in friction in the engine, for example at the piston ring and liner contact.

Fuels

Suitable liquid fuels, particularly for internal combustion engines include hydrocarbon fuels, oxygenate fuels and combinations thereof. Hydrocarbon fuels may be derived from mineral sources and/or from renewable sources such as biomass (e.g. biomass-to-liquid sources) and/or from gas-to-liquid sources and/or from coal-to-liquid sources. Suitable sources of biomass include sugar (e.g. sugar to diesel fuel) and algae. Suitable oxygenate fuels include alcohols for example, straight and/or branched chain alkyl alcohols having from 1 to 6 carbon atoms, esters for example, fatty acid alkyl esters and ethers, for example methyl tert butyl ether. Suitable fuels may also include LPG-diesel fuels (LPG being liquefied petroleum gas). The fuel composition may be an emulsion. However, suitably, the fuel composition is not an emulsion.

Suitable fatty acid alkyl esters include methyl, ethyl, propyl, butyl and hexyl esters. Usually, the fatty acid alkyl ester is a fatty acid methyl ester. The fatty acid alkyl ester may have 8 to 25 carbon atoms, suitably 12 to 25 carbon atoms, for example 16 to 18 carbon atoms. The fatty acid may be saturated or unsaturated. Usually, the fatty acid alkyl ester is acyclic. Fatty acid alkyl esters may be prepared by esterification of one or more fatty acids and/or by transesterification of one or more triglycerides of fatty acids. The triglycerides may be obtained from vegetable oils, for example castor oil, soyabean oil, cottonseed oil, sunflower oil, rapeseed oil (which is sometimes called canola oil), Jatropha oil or palm oil, or obtained from tallow (for example sheep and/or beef tallow), fish oil or used cooking oil. Suitable fatty acid alkyl esters include rapeseed oil methyl ester (RME), soya methyl ester or combinations thereof.

In at least some examples the fuel composition according to the present invention is prepared by admixing in one or more steps, a hydrocarbon fuel, an oxygenate fuel or a combination thereof with an effective amount of compound represented by structural formula (I) and optionally at least one other fuel additive.

The method of preparing a fuel composition and the method of improving the friction properties of a liquid fuel may each comprise admixing in one or more steps said liquid fuel (which may be for example a hydrocarbon fuel, an oxygenate fuel or a combination thereof) with an effective amount of compound represented by structural formula (I) and optionally at least one other fuel additive.

The liquid fuel may be admixed with at least one additive in one or more steps by methods known in the art. The additives may be admixed as one or more additive concentrates or part additive package concentrates, optionally comprising solvent or diluent. The hydrocarbon fuel, oxygenate fuel or combination thereof may be prepared by admixing in one or more steps by methods known in the art, one or more base fuels and components therefor, optionally with one or more additives and/or part additive package concentrates. The additives, additive concentrates and/or part additive package concentrates may be admixed with the fuel or components therefor in one or more steps by methods known in the art.

Fuels and Concentrates for Compression-Ignition Engines.

In at least some examples the fuel composition of the present invention is suitable for use in an internal combustion engine which is a compression-ignition internal combustion engine, suitably a direct injection diesel engine, for example of the rotary pump, in-line pump, unit pump, electronic unit injector or common rail type, or in an indirect injection diesel engine. In at least some examples the fuel composition is suitable for use in heavy and/or light duty diesel engines.

In at least some examples the fuel composition for compression-ignition internal combustion engines has a sulphur content of up to 500 ppm by weight, for example, up to 15 ppm by weight or up to 10 ppm by weight. Suitably, the fuel composition for compression-ignition internal combustion engines meets the requirements of for example, the EN590 standard, for example as set out in BS EN 590:2009.

Suitable oxygenate components in the fuel composition for compression-ignition internal combustion engines include fatty acid alkyl esters, for example fatty acid methyl esters. The fuel may comprise one or more fatty acid methyl esters complying with EN 14214 at a concentration of up to 7% by volume. Oxidation stability enhancers may be present in the fuel composition comprising one or more fatty acid alkyl or methyl esters, for example at a concentration providing an action similar to that obtained with 1000 mg/kg of 3,5-di-tert-butyl-4-hydroxy-toluol (also called butylated hydroxyl-toluene or BHT). Dyes and/or markers may be present in the fuel composition for compression-ignition internal combustion engines.

In at least some examples the fuel composition for compression-ignition internal combustion engines exhibits one or more (for example, all) of the following, for example, as defined according to BS EN 590:2009:— a minimum cetane number of 51.0, a minimum cetane index of 46.0, a density at 15° C. of 820.0 to 845.0 kg/m$^3$, a maximum polycyclic aromatic content of 8.0% by weight, a flash point above 55° C., a maximum carbon residue (on 10% distillation) of 0.30% by weight, a maximum water content of 200 mg/kg, a maximum contamination of 24 mg/kg, a class1 copper strip corrosion (3 h at 50° C.), a minimum oxidation stability limit of 20 h according to EN 15751 and a maximum oxidation stability limit of 25 g/m$^3$ according to EN ISO 12205, a maximum limit for lubricity corrected wear scar diameter at 60° C. of 460 μm, a minimum viscosity at 40° C. of 2.00 mm$^2$/s and a maximum viscosity at 40° C. of 4.50 mm$^2$/s, <65% by volume distillation recovery at 250° C., a minimum distillation recovery at 350° C. of 85% by volume and a maximum of 95% by volume recovery at 360° C.

The fuel composition and the additive concentrate for a fuel composition suitable for use in a compression-ignition internal combustion engine may each further comprise at least one friction modifier other than the compound represented by structural formula (I). Such other friction modifiers include compounds described herein as friction modifiers for lubricating compositions and additive concentrates for lubricating compositions.

The fuel composition and the additive concentrate for a fuel composition suitable for use with a compression-ignition internal combustion engine may each further comprise at least one lubricity additive. Suitable lubricity additives include tall oil fatty acids, mono- and di-basic acids and esters.

The fuel composition and the additive concentrate for a fuel composition suitable for use in a compression-ignition internal combustion engine may each further comprise independently one or more cetane improver, one or more detergent, one or more anti-oxidant, one or more anti-foam, one or more demulsifier, one or more cold flow improver, one or more pour point depressant, one or more biocide, one or more odorant, one or more colorant (sometimes called dyes), one or more marker, one or more spark aiders and/or combinations of one or more thereof. Other suitable additives which may be present include thermal stabilizers, metal deactivators, corrosion inhibitors, antistatic additives, drag reducing agents, emulsifiers, dehazers, anti-icing additives, antiknock additives, anti-valve-seat recession additives, surfactants and combustion improvers, for example as described in EP-2107102-A.

In at least some examples the additive concentrate for a fuel composition for a compression-ignition internal combustion engine comprises solvent. Suitable solvents include carrier oils (for example mineral oils), polyethers (which may be capped or uncapped), non-polar solvents (for example toluene, xylene, white spirits and those sold by Shell companies under the trade mark "SHELLSOL"), and polar solvents (for example esters and alcohols e.g. hexanol, 2-ethylhexanol, decanol, isotridecanol and alcohol mixtures, for example those sold by Shell companies under the trade mark "LINEVOL", e.g. LINEVOL 79 alcohol which is a mixture of $C_{7-9}$ primary alcohols, or a $C_{12-14}$ alcohol mixture which is commercially available.

Suitable cetane improvers include 2-ethyl hexyl nitrate, cyclohexyl nitrate and di-tert-butyl peroxide. Suitable anti-foams include siloxanes. Suitable detergents include polyolefin substituted succinimides and succinimides of polyamines, for example polyisobutylene succinimides, polyisobutylene amine succinimides, aliphatic amines, Mannich bases and amines and polyolefin (e.g. polyisobutylene) maleic anhydride. Suitable antioxidants include phenolic antioxidants (for example 2,6-di-tert-butylphenol) and aminic antioxidants (for example N,N'-di-sec-butyl-p-phenylenediamine). Suitable anti-foaming agents include polyether-modified polysiloxanes.

The representative suitable and more suitable independent amounts of additives (if present) in the fuel composition suitable for a compression-ignition engine are given in Table 3. The concentrations expressed in Table 3 are by weight of active additive compounds that is, independent of any solvent or diluent.

The additives in the fuel composition suitable for use in compression-ignition internal combustion engines are suitably present in a total amount in the range of 100 to 1500 ppm by weight. Therefore, the concentrations of each additive in an additive concentrate will be correspondingly higher than in the fuel composition, for example by a ratio of 1:0.0002 to 0.0015. The additives may be used as part-packs, for example part of the additives (sometimes called refinery additives) being added at the refinery during manufacture of a fungible fuel and part of the additives (sometimes called terminal or marketing additives) being added at a terminal or distribution point. The compound represented by structural formula (I) may suitably be added or used as a refinery or marketing additive, preferably as a marketing additive for example at a terminal or distribution point.

TABLE 3

| | Fuel composition for compression-ignition internal combustion engine | |
|---|---|---|
| Additive type | Suitable amount (actives), if present (ppm by weight) | More suitable amount (actives), if present (ppm by weight) |
| Friction modifier compound represented by structural formula (I) | 20 to 500 | 20 to 200 |
| Lubricity additives | 1 to 200 | 50 to 200 |
| Cetane improvers | 50 to 2000 | 100 to 1200 |
| Detergents | 20 to 300 | 50 to 200 |
| Anti-oxidants | 1 to 100 | 2 to 50 |
| Anti foams | 1 to 50 | 5 to 20 |
| Demulsifiers | 1 to 50 | 5 to 25 |
| Cold flow improvers | 10 to 500 | 50 to 100 |

Fuels and Concentrates for Spark-Ignition Engines.

In at least some examples the fuel composition of the present invention is suitable for use in an internal combustion engine which is a spark-ignition internal combustion engine.

In at least some examples the fuel composition for spark-ignition internal combustion engines has a sulphur content of up to 50.0 ppm by weight, for example up to 10.0 ppm by weight.

The fuel composition for spark-ignition internal combustion engines may be leaded or unleaded.

In at least some examples the fuel composition for spark-ignition internal combustion engines meets the requirements of EN 228, for example as set out in BS EN 228:2008. In at least some examples the fuel composition for spark-ignition internal combustion engines meets the requirements of ASTM D 4814-09b.

In at least some examples the fuel composition for spark-ignition internal combustion engines exhibits one or more (for example, all) of the following, for example, as defined according to BS EN 228:2008:— a minimum research octane number of 95.0, a minimum motor octane number of 85.0 a maximum lead content of 5.0 mg/1, a density of 720.0 to 775.0 kg/m$^3$, an oxidation stability of at least 360 minutes, a maximum existent gum content (solvent washed) of 5 mg/100 ml, a class 1 copper strip corrosion (3 h at 50° C.), clear and bright appearance, a maximum olefin content of 18.0% by weight, a maximum aromatics content of 35.0% by weight, and a maximum benzene content of 1.00% by volume.

Suitable oxygenate components in the fuel composition for spark-ignition internal combustion engines include straight and/or branched chain alkyl alcohols having from 1 to 6 carbon atoms, for example methanol, ethanol, n-propanol, n-butanol, isobutanol, tert-butanol. Suitable oxygenate components in the fuel composition for spark-ignition internal combustion engines include ethers, for example having 5 or more carbon atoms. In at least some examples the fuel composition has a maximum oxygen content of 2.7% by mass. In at least some examples the fuel composition has maximum amounts of oxygenates as specified in EN 228, for example methanol: 3.0% by volume, ethanol: 5.0% by volume, isopropanol: 10.0% by volume, iso-butyl alcohol: 10.0% by volume, tert-butanol: 7.0% by volume, ethers ($C_5$ or higher): 10% by volume and other oxygenates (subject to suitable final boiling point): 10.0% by volume. In at least some examples the fuel composition comprises ethanol complying with EN 15376 at a concentration of up to 5.0% by volume.

The fuel composition and the additive concentrate for a fuel composition suitable for use in a spark-ignition internal combustion engine may each further comprise at least one friction modifier other than the compound represented by structural formula (I). Such other friction modifiers include compounds described herein as friction modifiers for lubricating compositions and additive concentrates for lubricating compositions.

The fuel composition and the additive concentrate for a fuel composition suitable for use in a spark-ignition internal combustion engine may each further comprise independently one or more detergent, one or more octane improver, one or more friction modifier, one or more anti-oxidant, one or more valve seat recession additive, one or more corrosion inhibitor, one or more anti-static agent, one or more odorant, one or more colorant, one or more marker and/or combinations of one or more thereof.

In at least some examples the additive concentrate for a fuel composition for a spark-ignition internal combustion engine comprises solvent. Suitable solvents include polyethers and aromatic and/or aliphatic hydrocarbons, for example heavy naphtha e.g. Solvesso (Trade mark), xylenes and kerosine.

Suitable detergents include poly isobutylene amines (PIB amines) and polyether amines.

Suitable octane improvers include N-methyl aniline, methyl cyclopentadienyl manganese tricarbonyl (MMT) (for example present at a concentration of up to 120 ppm by weight), ferrocene (for example present at a concentration of up to 16 ppm by weight) and tetra ethyl lead (for example present at a concentration of up to 0.7 g/l, e.g. up to 0.15 g/1).

Suitable anti-oxidants include phenolic anti-oxidants (for example 2,4-di-tert-butylphenol and 3,5-di-tert-butyl-4-hydroxyphenylpropionic acid) and aminic anti-oxidants (for example para-phenylenediamine, dicyclohexylamine and derivatives thereof).

Suitable corrosion inhibitors include ammonium salts of organic carboxylic acids, amines and heterocyclic aromatics, for example alkylamines, imidazolines and tolyltriazoles.

Valve seat recession additives may be present at a concentration of up to 15000 ppm by weight, for example up to 7500 ppm by weight.

The representative suitable and more suitable independent amounts of additives (if present) in the fuel composition suitable for a spark-ignition engine are given in Table 4. The concentrations expressed in Table 4 are by weight of active additive compounds that is, independent of any solvent or diluent.

The additives in the fuel composition suitable for use in spark-ignition internal combustion engines are suitably present in a total amount in the range of 20 to 25000 ppm by weight. Therefore, the concentrations of each additive in an additive concentrate will be correspondingly higher than in the fuel composition, for example by a ratio of 1:0.00002 to 0.025. The additives may be used as part-packs, for example part of the additives (sometimes called refinery additives) being added at the refinery during manufacture of a fungible fuel and part of the additives (sometimes called terminal or marketing additives) being added at a terminal of distribution point. The compound represented by structural formula (I) may suitably be added or used as a refinery or marketing additive, preferably as a marketing additive for example at a terminal or distribution point.

TABLE 4

| | Fuel composition for spark-ignition internal combustion engine | |
|---|---|---|
| Additive type | Suitable amount (actives), if present (ppm by weight) | More suitable amount (actives), if present (ppm by weight) |
| Friction modifier compound represented by structural formula (I) | 20 to 500 | 20 to 200? |
| Friction modifiers other than compounds represented by structural formula (I) | 10 to 500 | 25 to 150 |
| Detergents | 10 to 2000 | 50 to 300 |
| Octane improvers | 50 to 20000 | |
| Anti-oxidants | 1 to 100 | 10 to 50 |
| Anti-static agents | 0.1 to 5 | 0.5 to 2 |

The invention will now be described by way of example only with reference to the following experiments and examples in which compounds and examples according to the present invention are labelled numerically as Compound 1, Compound 2 etc. and Example 1, Example 2 etc. Compounds and experiments not according to the present invention are labelled alphabetically as Compound A, Compound B etc. and Experiment A, Experiment B etc. Preparation of precursors and compounds are labelled Preparation A, Preparation B etc.

PREPARATION OF PRECURSORS

Preparation A—Preparation of oleyl methanesulphonate

Oleyl alcohol, also called cis 9 octadecen-1-ol, (100 g, 0.37M) was dissolved in DCM, dichloromethane and cooled to 0° C. Triethylamine (56.5 g, 78 ml, 0.56M, 1.5 equivalents) was added to the solution at this temperature and the mixture was stirred for one hour. Methanesulphonyl chloride (47 g, 31.8 ml, 1.1 equivalents) was then added to the mixture at this temperature and the mixture was stirred at 0° C. for 30 minutes before being allowed to warm to room temperature. The reaction mixture was washed with ice/water, cold 10% hydrochloric acid, cold solution of sodium bicarbonate, water and brine successively, then dried with sodium sulphate. After filtration, the solvent was removed under vacuum to yield and oil which was chilled overnight to yield a solid with a low melting point (yield 126.5 g, 99%).

Preparation B—Preparation of oleyl methanesulphonate (Repeat)

Preparation A was repeated using 410 g oleyl alcohol, 2 liters DCM, 322 ml triethylamine, 194 g methane sulphonylchloride to yield 510 g (96%) oleyl methanesulphonate product.

Preparation C—Preparation of di-tert.butyl-benzyl-iminodiacetate

Benzylamine (9.8 g 0.0915M) was dissolved in acetonitrile (250 ml). Freshly ground potassium carbonate (40 g, 0.29M) was added with stirring at room temperature, followed by butyl bromoacetate (35.7 g 0.183M) in acetonitrile (50 ml). The reaction mixture was stirred overnight at room temperature. The solids were removed by filtration and the cake was washed with acetonitrile. The filtrates were reduced by rotary evaporation at 40° C. giving an oil which was solidified, giving an impure white solid with a melting point of about 35° C. at a yield of 31.3 g (102%).

Preparation D—Preparation of di-tert.butyl-benzyl-iminodiacetate (Repeat)

Benzylamine (58.4 g, 59.5 ml, 0.55M) was dissolved in acetonitrile (1 liter) and potassium carbonate (239 g, excess) was added with stirring at room temperature. Butyl bromoacetate (214 g, 161 ml, 1.1M) in acetonitrile (200 ml) was added drop-wise, keeping the temperature at less than 25° C. The reaction mixture was stirred overnight at room temperature. The solids were removed by filtration and the cake was washed with three portions of acetonitrile, combined and the solvent was removed by rotary evaporation at 40° C. giving a pale straw coloured oil which was crystallised to give a white solid with a melting point of about 35° C. and a yield of 183.4 g (100%).

Preparation E—Preparation of di-tert.butyliminodiacetate

Di-tert.butyl-benzyl-iminodiacetate prepared in Preparations C/D above (5 g, 0.015M), IMS (industrial methylated spirit) (25 ml) and palladium on carbon catalyst, 10% (100 mg) were stirred under an atmosphere of hydrogen at room temperature and pressure for 24 hours. TLC showed no staring material. The catalyst was filtered off (through a celite bed) and the solvent removed giving a pale brown oil which solidified overnight. Melting point 36-38° C., yield 3.29 g (90%)

Preparation F—Preparation of di-tert.butyliminodiacetate (Repeat)

Di-tert.butyl-benzyl-iminodiacetate prepared as in Preparations C/D above (204 g, 0.608M) in IMS (industrial methylated spirit) (1.2 liter) and palladium on carbon catalyst, 10% dampened with water (5 g) were charged to a 4 liter autoclave and hydrogenated at 10 bar, topping up with hydrogen as required. When uptake was complete, the contents were removed from the vessel and filtered through celite. The IMS was removed giving a pale brown oil which solidified. Yield was 142 g (96%), melting point 36-38° C.

Preparation of Compounds not According to the Present Invention

Compound X—Oleyl-diethylmalonate

Oleyl-diethylmalonate is not a compound which is represented by the structural formula (I) according to the present invention because the compound has a carbon atom instead of the nitrogen atom of that structure.

This compound may be represented by the structural formula (II):

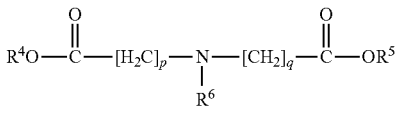

(II)

wherein p=q=0;

$R^4$ is the same as $R^5$ and both are ethyl groups; and $R^6$ represents an oleyl group.

Preparation G—Preparation of oleyl-diethylmalonate from diethyl malonate and oleyl methane sulphonate (Compound X)

Sodium hydride 60% (2 g, 0.05M) was washed 3 times with hexane to remove mineral oil. The THF (tetrahydrofuran) (60 ml) was added followed by drop-wise addition of diethyl malonate (6.4 g, 0.04M) in THF (10 ml), with monitoring of temperature to less than 25° C. The reaction mixture was stirred at room temperature for two hours. Then oleyl methanesulphonate prepared as in Preparations A/B above (13.88 g, 1 equivalent) in THF (10 ml) was added drop-wise at room temperature. Then the mixture was brought to reflux and refluxed for 2 hours before being cooled overnight. The reaction was quenched with water, then extracted 3 times with diethyl ether. The extracts were combined and washed 2 times with water, then with brine, dried with sodium sulphate and filtered. The filtrate was concentrated under vacuum giving a pale brown oil. Yield was 15 g (91%).

Preparation H—Preparation of oleyl-diethylmalonate from diethyl malonate and oleyl methane sulphonate (Compound X) (Repeat)

Sodium hydride 60% (14 g, excess) was washed 3 times with hexane. Then THF (420 ml) was added. Diethyl malonate (448 g, 0.28M) in THF (30 ml) was added at room temperature (less than 25° C.) with effervescence. The mixture was stirred for 2 hours at room temperature. Oleyl methanesulphonate prepared as in Preparations A/B above (97.16 g, 0.28 M) in THF (80 ml) was added drop-wise and the mixture was stirred at room temperature overnight (no visible reaction). The mixture was stirred/refluxed for 8 hours then cooled overnight. The reaction was quenched with water, then diethyl ether was added and the mixture extracted with water 2 times then with brine. The mixture was dried with sodium sulphate, filtered and the volatiles removed under vacuum. Yield was 100 g (87%).

Preparation of Friction Modifier Compounds Represented by Structural Formula (I)

Compound 1—Diethyl-oleyl-iminodiacetate

Diethyl-oleyl-iminodiacetate which is a compound represented by the structural formula (I) in which $R^3$ represents oleyl; m=n=1; and $R^1$ and $R^2$ are the same and are ethyl groups was prepared as follows.

Diethyliminodiacetate (63 g, 0.33M), ground potassium carbonate 80 g (excess), acetonitrile (950 ml), 18 crown6 (100 mg), sodium iodide (55 g, 1 equivalent) and oleyl methanesulphonate prepared as in Preparations A/B above (129 g, 1.1 equivalent) were stirred and refluxed for 20 hours. Thin Layer Chromatography analysis showed little of the iminoacetate product. 5 g of KE705 and 3 g of sodium iodide were added to the mixture and the mixture was refluxed for 3 hours more. TLC showed better levels of product. The reaction mixture was cooled and filtered. The cake was washed with acetonitrile and the organic solutions combined and reduced to an oil under vacuum. The oil was partitioned between ether and water and separated. The aqueous layer was extracted twice more with ether and the ether layers were combined, washed 2 times with water then brine. After drying with sodium sulphate and filtering the solution was reduced to an oil under vacuum. Yield was 145 g (100%). Analysis by NMR was fair.

Compound 2—Di-tert.butyl-oleyl-iminodiacetate

Di-t-butyl-oleyl-iminodiacetate which is a compound represented by the structural formula (I) in which, $R^3$ represents oleyl; m=n=1; and $R^1$ and $R^2$ are the same and are tert-butyl groups was prepared as follows.

Di-tert.butyliminodiacetate prepared as in Preparations E/F above (100 g, 0.41 M), oleyl methanesulphonate prepared as in Preparations A/B above (141 g), potassium carbonate (dry ground) 60 g (excess), sodium iodide (61 g, 1 equivalent), acetonitrile (1200 ml), and 18 crown6 (100 mg) were stirred and refluxed overnight (20 hours). TLC showed significant amounts of di-tert.butyliminodiacetate. A further 20 g of oleyl methanesulphonate and 10 g of sodium iodide were added and refluxing was continued for a further 7 hours. The reaction mixture was stirred overnight at room temperature. The solids were removed by filtration; an oil which appeared to be product made this very slow. The cake was washed with hexane and ether and all of the organics were combined and the volatiles removed under vacuum. The resulting oil and solids was taken up in ether and washed with water 2 times and brine and then dried with sodium sulphate, filtered. TLC and NMR analysis showed very little di-tert.butyliminodiacetate but quite a lot of the faster running impurities. Yield was 173.8 g (85%).

Preparation of Lubricating Compositions

Lubricating compositions were formulated with an additive package (10.21 wt %), which contained a conventional non-borated dispersant, calcium sulfonate and phenate detergents, phenolic and aminic antioxidants, anti foam and Group III base oil. The lubricating compositions also comprised ZDDP at a treat rate corresponding to either zero (for lubricating composition A) or low (400 ppm) phosphorus content (for lubricating composition B), a viscosity modifier (4%) and a mixture of Yubase 4 and 6 base oils. The lubricating compositions were formulated to 0W20 grade, modelling a typical lubricating composition which might be used to lubricate an internal combustion engine (spark or compression ignition), for example as a crankcase lubricant.

Lubricating compositions A and B were the same except that lubricating composition A did not contain any zinc dialkyl dithiophosphate (ZDDP) and lubricating composition B contained ZDDP at a concentration corresponding to 400 ppm phosphorus. Lubricating compositions A and B are not according to the present invention because the lubricating compositions do not contain any friction modifier represented by structural formula (I). The physical properties of lubricating compositions A and B are given in Table 5.

TABLE 5

| | | Composition A no ZDDP | Composition B ZDDP at 400 ppm P |
|---|---|---|---|
| KV40 | cSt | 44.18 | 44.20 |
| KV100 | cSt | 8.31 | 8.28 |
| VI | | 166 | 165 |

Lubricating compositions comprising Compound X and friction modifier compounds represented by structural formula (I) (Compounds 1 and 2) were prepared to have various amounts of components as shown in Tables 6 and 7.

HFRR Friction Tests.

A High Frequency Reciprocating Rig friction test was undertaken for the comparison lubricating compositions A and B and for lubricating compositions comprising Compound X and friction modifier compounds represented by structural formula (I) (Compounds 1 and 2).

The HFRR test is usually used to assess lubricity of diesel fuels (according to ASTM D6079-97). It may also be used to assess friction coefficients between sliding solid surfaces in the presence of lubricant compositions with various friction modifiers over a temperature range and hence the test may be used to assess the performance of the friction modifiers.

The HFRR tests were run using the following test profile:

Load=350 g,

Frequency=40 Hz,

Stroke Length=1000 microns,

Temperatures 60° C., 90° C., 120° C., held at each temperature for 15 minutes.

Friction coefficient was measured at each temperature and the overall friction coefficient is calculated as an average of the friction coefficients at each temperature.

Table 6 shows the HFRR test results for the lubricating compositions with and without Compounds 1 and 2 in the absence of ZDDP.

Table 7 shows the HFRR test results for the lubricating compositions with and without Compounds X, 1 and 2 in the presence of ZDDP in an amount corresponding to 400 ppm P.

The HFRR test results in Table 6 show that in the absence of ZDDP, the presence of compounds represented by structural formula (I) e.g. diethyl-oleyl-iminodiacetate (Compound 1) in a lubricating composition exhibit improved friction modifier properties (Examples 1 and 2) when compared to a lubricating composition without such a compound (Experiment A).

The HFRR test results in Table 7 show that in the presence of ZDDP (for example at a concentration corresponding to 400 ppm P), the presence of compounds represented by structural formula (I) e.g. diethyl-oleyl-iminodiacetate (Compound 1) or di-t-butyl-oleyl-iminodiacetate (Compound 2) in a lubricating composition exhibit improved friction modifier properties when compared to a lubricating composition without such a compound (Experiment B).

The results in Table 7 also show that the presence of Compounds 1 and 2 at 0.5 weight % provide lubricating compositions which have improved friction modifier properties compared to the lubricating composition which contained 0.5 weight % of Compound X (oleyl-diethyl malonate).

TABLE 6

(Friction Coefficients of Lubricating Compositions Without ZDDP)

| | | | Experiment A—Comparison | Example 1 | Example 2 |
|---|---|---|---|---|---|
| Composition A | 0% ZDDP | Wt. % | 100 | 99.5 | 99 |
| Compound 1 | diethyl-oleyl-iminodiacetate | Wt. % | | 0.5 | 1 |
| | | Total wt. % | | 100 | 100 |
| | KV40 | cSt | 44.18 | 43.47 | 43.03 |
| | KV100 | cSt | 8.31 | 8.24 | 8.18 |
| | VI | | 166 | 168 | 167 |
| HFRR | Friction Coeff | 60° C. | 0.131 | 0.115 | 0.111 |
| | Friction Coeff | 90° C. | 0.148 | 0.098 | 0.100 |
| | Friction Coeff | 120° C. | 0.149 | 0.083 | 0.086 |
| | Friction Coeff | Average | 0.142 | 0.099 | 0.099 |
| | % improvement in average friction co-efficient compared to Expt. A | | | 30 | 30 |

TABLE 7

(Friction Coefficients of Lubricating Compositions With ZDDP at 400 ppm P)

| | | | Expt. B | Expt. C | Example 3 | Example 4 | Example 5 | Example 6 |
|---|---|---|---|---|---|---|---|---|
| Composition B | 400 ppm P | Wt. % | 100 | 99.5 | 99.5 | 99.5 | 99 | 99.75 |
| Compound X | oleyl-diethylmalonate | Wt. % | | 0.5 | | | | |
| Compound 1 | diethyl-oleyl-iminodiacetate | Wt. % | | | | 0.5 | 1 | 0.25 |
| Compound 2 | di-t-butyl-oleyl-iminodiacetate | Wt. % | | | 0.5 | | | |
| | | Total wt. % | 100 | 100 | 100 | 100 | 100 | 100 |
| | KV40 | cSt | 44.20 | 43.84 | 43.86 | 43.63 | 43.13 | 43.98 |
| | KV100 | cSt | 8.28 | 8.24 | 8.24 | 8.21 | 8.14 | 8.24 |
| | VI | | 165 | 166 | 165 | 166 | 165 | 165 |
| | Friction Coeff | 60° C. | 0.111 | 0.109 | 0.110 | 0.109 | 0.110 | 0.109 |
| HFRR | Friction Coeff | 90° C. | 0.117 | 0.104 | 0.105 | 0.100 | 0.099 | 0.099 |
| | Friction Coeff | 120° C. | 0.134 | 0.114 | 0.106 | 0.086 | 0.087 | 0.087 |
| | Friction Coeff | Average | 0.120 | 0.109 | 0.107 | 0.098 | 0.099 | 0.098 |
| | % improvement in average friction coefficient compared to Expt. B | | | 9 | 11 | 18 | 18 | 18 |

The results in Table 6 (without ZDDP) and in Table 7 (with ZDDP at 400 ppm P) show that the compounds represented by structural formula (I) exhibit friction modifier properties and so would be suitable for use for example in a non-aqueous lubricating composition, in a method of lubricating an internal combustion engine, in a method of improving the friction properties of an oil of lubricating viscosity, in a method of preparing a non-aqueous lubricating composition, in an additive concentrate for a non-aqueous lubricating composition, in a fuel composition (for example for an internal combustion engine), in a method of improving the friction properties of a liquid fuel, in a method of preparing a fuel composition for an internal combustion engine, in an additive concentrate for a fuel composition for an internal combustion engine and in a method of operating an internal combustion engine.

The invention claimed is:

1. A non-aqueous lubricating composition comprising a major amount of an oil of lubricating viscosity and a minor amount in the range of 0.02% to 5% by weight, of at least one compound having the structural formula (I):

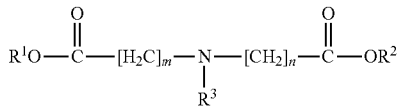

(I)

wherein:

m and n are each independently an integer in the range 1 to 6;

$R^1$ and $R^2$ each independently represent $C_1$ to $C_{10}$ hydrocarbyl or substituted hydrocarbyl group; and $R^3$ represents a $C_{10}$ to $C_{26}$ hydrocarbyl group.

2. The lubricating composition as claimed in claim 1 in which the compound represented by the structural formula (I) is present in a liquid fuel composition used to operate an internal combustion engine and a portion at least, of said compound ingresses into the lubricating composition during operation of said engine.

3. The lubricating composition as claimed in claim 1 in which in the structural formula (I), $R^3$ represents a $C_{12}$, $C_{14}$, $C_{16}$ or $C_{18}$ hydrocarbyl group.

4. The lubricating composition as claimed in claim 3 in which in the structural formula (I), $R^3$ represents a saturated hydrocarbyl group.

5. The lubricating composition as claimed in claim 1 in which in the structural formula (I), $R^3$ represents an oleyl group.

6. The lubricating composition as claimed in claim 1 in which in the structural formula (I), m and n are each 1.

7. The lubricating composition as claimed in claim 1 in which in the structural formula (I), $R^1$ and $R^2$ each independently represent a saturated hydrocarbyl group.

8. The lubricating composition as claimed in claim 1 in which in the structural formula (I), $R^1$ and $R^2$ each independently represent an ethyl or tert-butyl group.

9. The lubricating composition as claimed in claim 1 in which in the structural formula (I), $R^1$ and $R^2$ each independently represent a substituted hydrocarbyl group comprising at least one heteroatom which is selected from the group consisting of nitrogen, oxygen and combinations thereof.

10. The lubricating composition as claimed in claim 1 in which in the structural formula (I), $R^3$ represents oleyl; m=n=1; and $R^1$ and $R^2$ are the same and are ethyl or tert-butyl groups.

11. A fuel composition for an internal combustion engine which composition comprises a major amount of a liquid fuel and a minor amount of at least one compound represented by the structural formula (I) as defined in claim 1 in which $R^1$ and $R^2$ each independently represent a $C_1$ to $C_{10}$ hydrocarbyl or substituted hydrocarbyl group.

12. A fuel composition as claimed in claim 11 in which in the structural formula (I), $R^3$ represents a saturated hydrocarbyl group.

13. A fuel composition as claimed in claim 11 in which in the structural formula (I), $R^3$ represents an oleyl group.

14. A fuel composition as claimed in claim 11 in which in the structural formula (I), m and n are each 1.

15. A fuel composition as claimed in claim 14 in which in the structural formula (I), $R^1$ and $R^2$ each independently represent a saturated hydrocarbyl group.

16. A fuel composition as claimed in claim 15 in which in the structural formula (I), $R^1$ and $R^2$ each independently represent an ethyl or tert-butyl group.

17. A fuel composition as claimed in claim 11 in which in the structural formula (I), $R^1$ and $R^2$ each independently represent a substituted hydrocarbyl group comprising at least one heteroatom which is selected from the group consisting of nitrogen, oxygen and combinations thereof.

18. A fuel composition as claimed in claim 11 in which in the structural formula (I), $R^3$ represents oleyl; m=n=1; and $R^1$ and $R^2$ are the same and are ethyl or tert-butyl groups.

* * * * *